US007497063B2

(12) United States Patent
Huang

(10) Patent No.: US 7,497,063 B2
(45) Date of Patent: Mar. 3, 2009

(54) APPARATUS FOR SEALING CRYOVIAL

(76) Inventor: Kun-Chuan Huang, 7F.-1, No.8, Lane 609, Sec. 5, Chongsin Rd., Sanchong City, Taipei County 241 (TW)

( * ) Notice: Subject to any disclaimer, the term of this patent is extended or adjusted under 35 U.S.C. 154(b) by 346 days.

(21) Appl. No.: 11/490,177

(22) Filed: Jul. 21, 2006

(65) Prior Publication Data

US 2008/0016821 A1 Jan. 24, 2008

(51) Int. Cl.
*B65B 51/04* (2006.01)

(52) U.S. Cl. ..... 53/137.2; 53/133.1; 53/131.1

(58) Field of Classification Search ..... 53/131.1, 53/133.1, 137.2, 209, 557, 284.6
See application file for complete search history.

(56) References Cited

U.S. PATENT DOCUMENTS 6,336,489 B1 * 1/2002 McGahhey ..... 156/368
7,007,445 B2 * 3/2006 Louviere ..... 53/467
2006/0019388 A1 * 1/2006 Hutmacher et al. ..... 435/394

* cited by examiner

*Primary Examiner*—Hemant M Desai
(74) *Attorney, Agent, or Firm*—Leong C. Lei

(57) ABSTRACT

An apparatus includes a holder; a first motor operatively secured to holder; a transporting assembly including a second motor and a slide; a heating unit; a controller; and a housing for enclosing the transporting assembly and the heating unit; A thermally contractible film is put on a closed cryovial containing biological specimens. The cryovial is secured to the holder such that activating the second motor to move the first motor and the holder from an original position to a heating position, stopping the second motor and activating the first motor to turn the holder about a length axis of the cryovial, activating the heating unit to heat the thermally contractible film and contracting same onto the cryovial, and activating the second motor again to move the first motor and the holder from the heating position to the original position will produce a sealed cryovial.

1 Claim, 8 Drawing Sheets

APPARATUS FOR SEALING CRYOVIAL

BACKGROUND OF THE INVENTION

1. Field of Invention

The present invention relates to cryopreservation and more particularly to an apparatus for sealing a cryovial by contracting a thermally contractible film thereon by heating such that liquid nitrogen is prevented from permeating through the cryovial in a subsequent cryopreservation.

2. Related Art

Cryopreservation, is a process where biological specimens (e.g., cells, whole tissues, sperms, etc.) are contained in cryovials and then preserved by placing in liquid nitrogen by cooling to low sub-zero temperatures, such as −196° C. (the boiling point of liquid nitrogen). At these low temperatures, any biological activity, including the biochemical reactions that would lead to cell death is effectively stopped. However, when vitrification solutions are not used, the specimens being preserved are often damaged due to freezing during the approach to low temperatures, warming to room temperature, or liquid nitrogen permeating through cryovials (the most serious one).

It is often that liquid nitrogen held at very low sub-zero temperature may permeate through cryovials during cryopreservation. This is because expansion coefficient of cap of cryovial is different from that of main body thereof in which the cap and the main body are made of different materials. As a result, specimens in the cryovials are damaged. Moreover, cryovials may explode when warming to room temperature after removing from liquid nitrogen container. Currently, as a solution to the above problem, thermally contractible films are employed to put on cryovials. Next, a sealing machine is employed to heat thermally contractible films to contract same. The cryovials are thus sealed by the thermally contractible films. As a result, the liquid nitrogen permeation is avoided.

Taiwanese Invention Patent No. 271,816 discloses an apparatus for sealing cryovial as shown in FIGS. 1 to 3. The apparatus comprises a mount A, a heating and blowing unit B on a top of the mount A, a motor C in a lower part of the mount A, a vertical chain C1 driven by the motor C to move cyclically, a threaded rod D1 provided on the mount A and disposed between the heating and blowing unit B and the motor C, a platform D2 slidably provided on the threaded rod D1, a link C2 extending from an underside of the platform D2 to a top of the chain C1 such that the platform D2 is adapted to move vertically along the threaded rod D1 as driven by the motor C and the drain C1, a second motor D4 secured to the underside of the platform D2 and having a rotating shaft D5 upwardly passed through the platform D2, a holder D3 secured to the shaft D5 and adapted to firmly hold a bottom of a body F2 of a cryovial F with cap F1 and thermally contractible film F3 disposed externally of the holder D3, an axis of the shaft D5 being aligned with and connected to a length axis of the cryovial F such that the holder D3 and the cryovial F held by the holder D3 are adapted to rotate about a length axis of the cryovial F when the motor D4 activates, a controller (not shown) having circuitry electrically connected to the motor C, the second motor D4, and the heating and blowing unit B such that enabling the controller by turning on a switch (not shown) will activate the motor C, the second motor D4, and the heating and blowing unit B.

In operation, specimens are contained in the cryovial F and the thermally contractible film F3 is put on the cryovial F prior to being fastened by the holder D3. Next, activate the motor C to move both the second motor D4 and the holder D3 from the current position to a heating position to be heated for a predetermined period of time in cooperation with the chain C1, the link C2, and the platform D2. Next, stop the motor C and activate the second motor D4 to turn the holder D3. At the same time, the heating and blowing unit B heats the thermally contractible film F3. The thermally contractible film F3 thus contracts to fasten a joining portion of the cap F1 and the body F2. Stop the heating and blowing unit B and the second motor D4 immediately after the completion of the heating. Next, activates the motor C again to move both the second motor D4 and the holder D3 back to the original positions. Finally, remove the sealed cryovial F from the holder D3.

But this is unsatisfactory for the purpose for which the invention is concerned for the following reasons: The platform D2 is adapted to move vertically along the threaded rod D1. Further, a maximum moving distance of the platform D2 is limited due to the mechanism of the cooperating chain C1 and the link C2. As such, only cryovials of the same size are applicable to this apparatus. This can greatly limit applications of the apparatus and thus the sealing of cryovials. Thus, a need for improvement exists in order to overcome the inadequacies of the prior art and contributes significantly to the advancement of the art.

SUMMARY OF THE INVENTION

It is therefore an object of the present invention to provide an apparatus for sealing a cryovial by contracting a thermally contractible film thereon by heating such that liquid nitrogen is prevented from permeating through the cryovial in a subsequent cryopreservation.

To achieve the above and other objects, the present invention provides an apparatus comprising a holder including a lower extension and an upper hole; a first motor having a rotating shaft secured to the extension; a transporting assembly including a second motor having a rotating shaft, and a slide including a fixed seat having an elongated upper groove, a sliding block slidably fitted in the groove, a threaded rod having one end threadedly secured to the sliding block, and a coupling interconnected the other end of the threaded rod and the rotating shaft of the second motor such that the sliding block is adapted to slide relative to the seat when the second motor activates; a heating unit for generating heat and blowing hot air; a controller for controlling the first motor, the transporting assembly, and the heating unit, and setting parameters; and a housing for enclosing the transporting assembly and the heating unit and including an exhaust fan; wherein a thermally contractible film is put on a closed cryovial containing biological specimens, and wherein the cryovial is secured to the hole such that setting parameters including a heating time and a heating temperature through the controller, enabling the controller to activate the second motor to move the first motor and the holder from an original position to a heating position, stopping the second motor and activating the first motor to turn the holder about a length axis of the cryovial, enabling the controller to activate the heating unit to heat the thermally contractible film to a temperature equal to the heating temperature for a predetermined period of time equal to the heating time for contracting the thermally contractible film onto the cryovial, and activating the second motor again to move the first motor and the holder from the heating position to the original position will produce a sealed cryovial.

In one aspect of the present invention the holder is cylindrical.

The above and other objects, features and advantages of the present invention will become apparent from the following detailed description taken with the accompanying drawings.

DETAILED DESCRIPTION OF THE INVENTION

Figure 1:
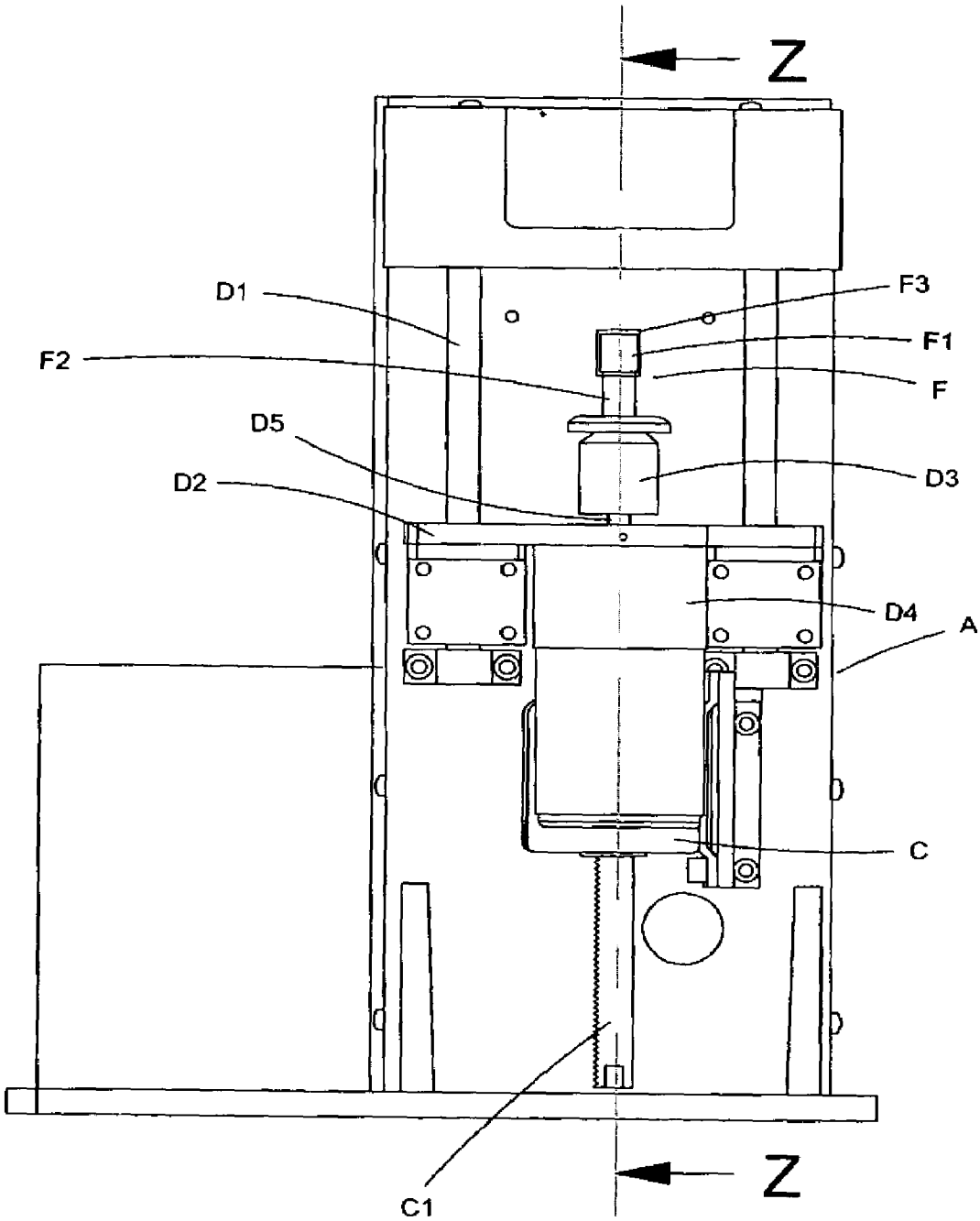
FIG. 1 PRIOR ART
FIG. 1 is a front view of an apparatus for sealing cryovial according to prior art.
Figure 2:
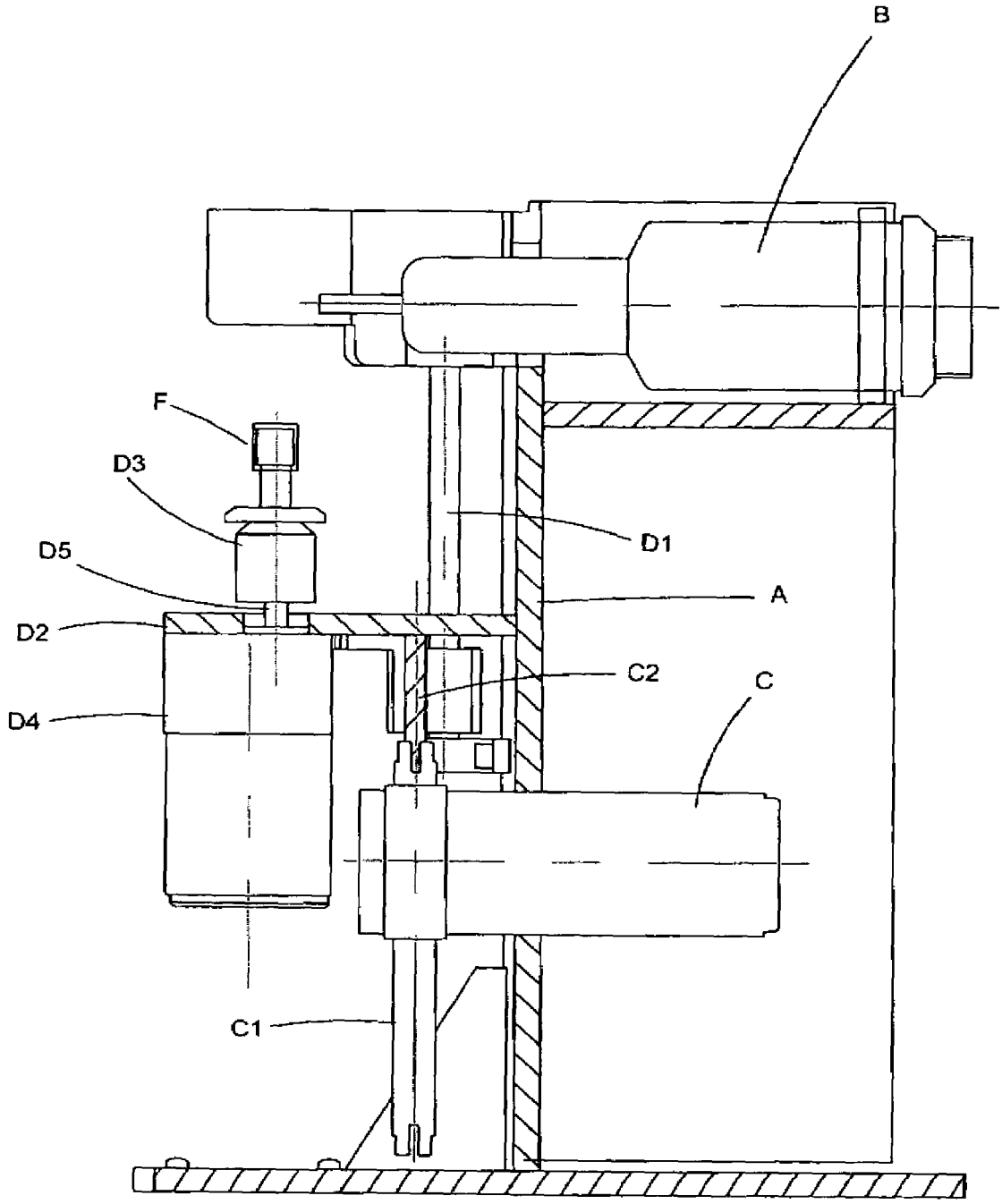
FIG. 2 PRIOR ART
FIG. 2 is a schematic sectional view taken along line Z-Z of FIG. 1.
Figure 3:
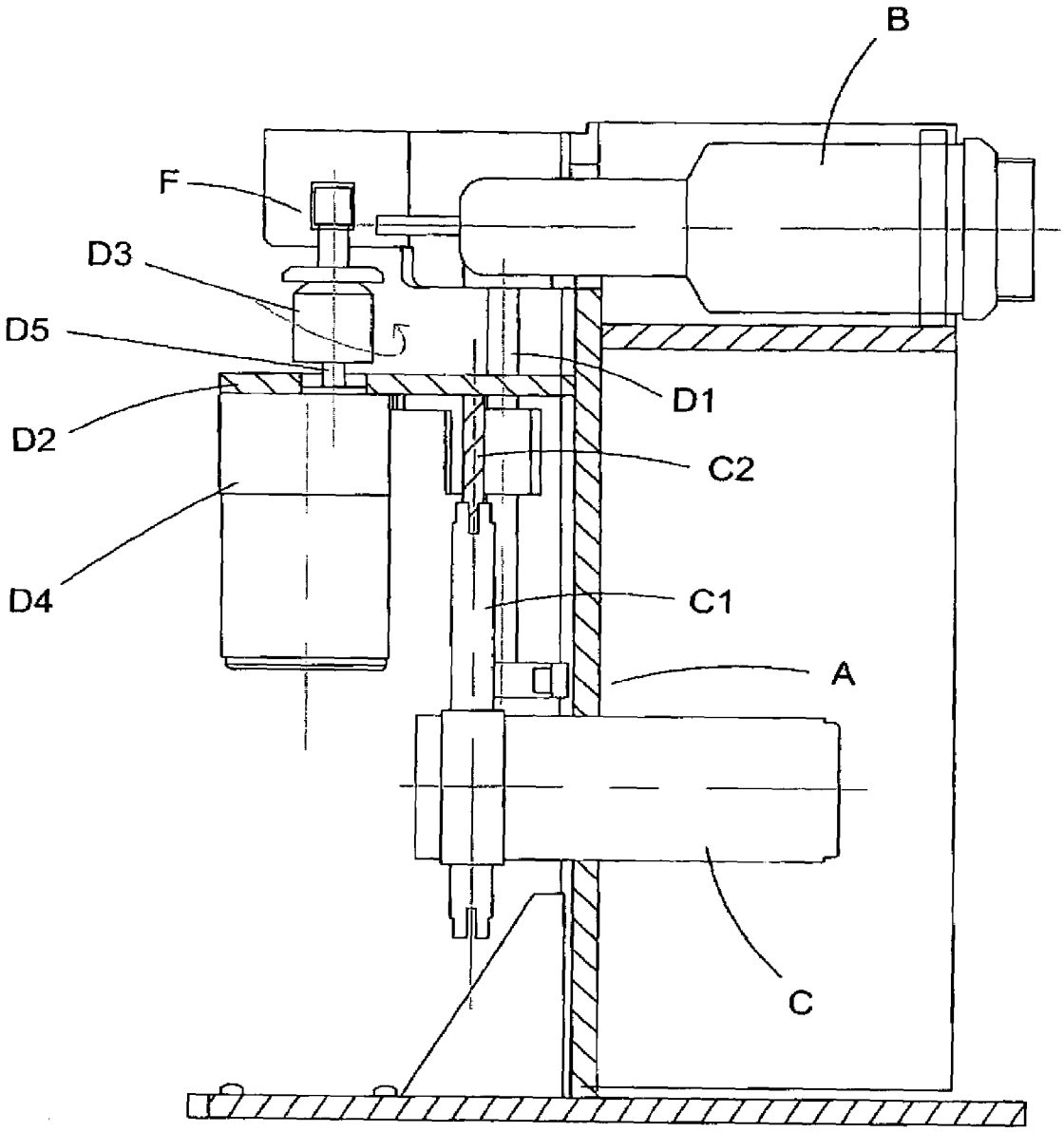
FIG. 3 PRIOR ART
FIG. 3 is a view similar to FIG. 2 where a sealing operation by heating is performed.
Figure 4:
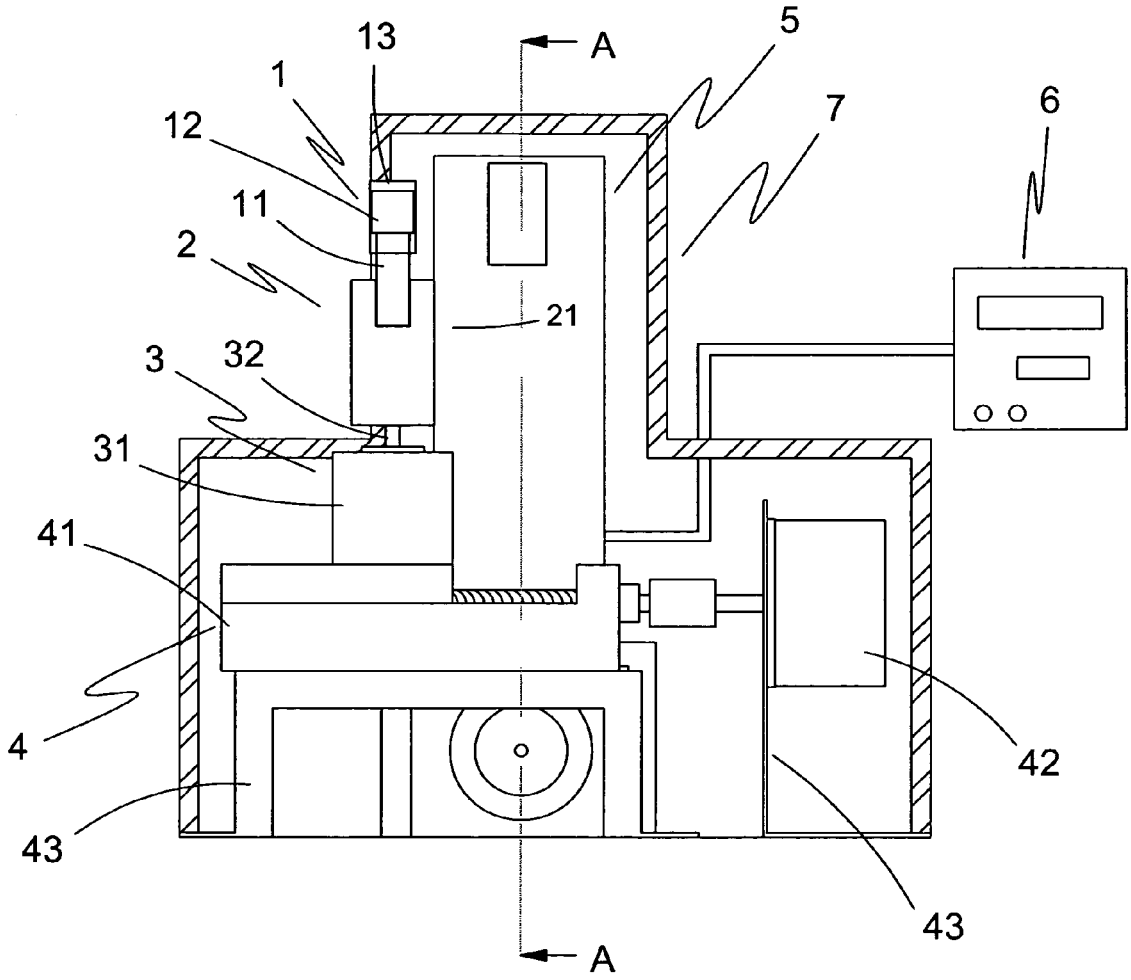
FIG. 4 is a front view of a preferred embodiment of apparatus for sealing cryovial to be used in cryopreservation according to the invention.
Figure 5:
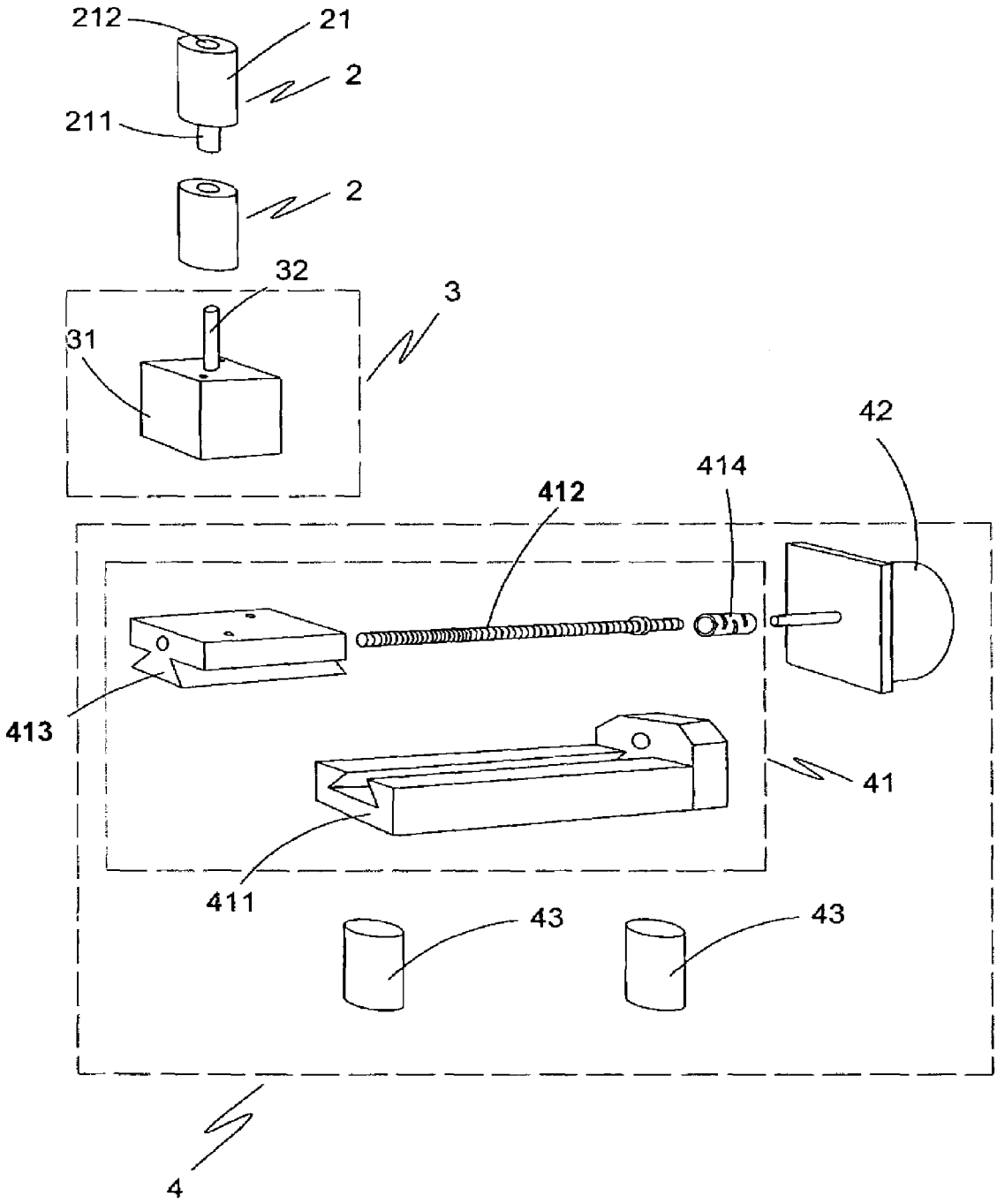
FIG. 5 is an exploded view of some important components of FIG. 4.
Figure 6:
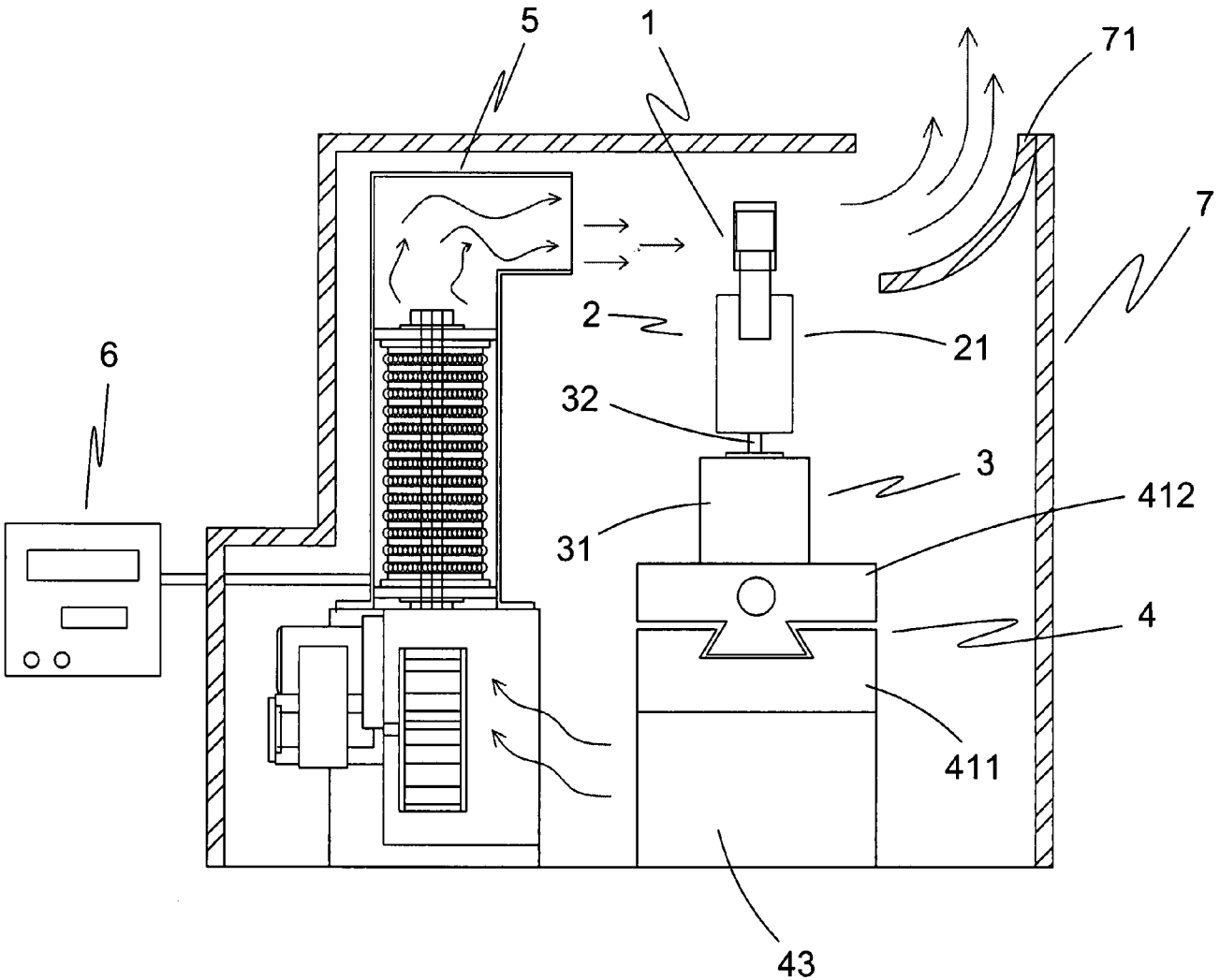
FIG. 6 is a schematic sectional view taken along line A-A of FIG. 4.
Figure 7:
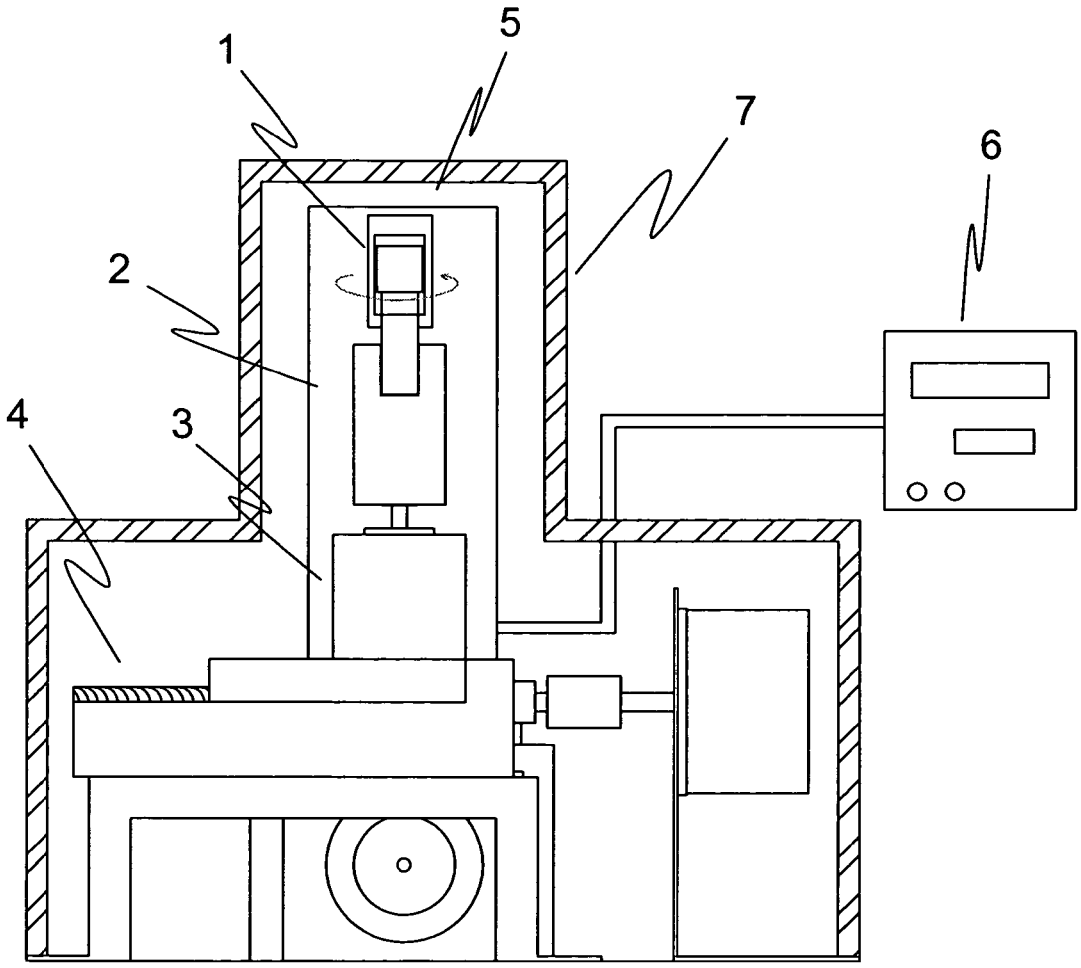
FIG. 7 is a front view of the apparatus of FIG. 4 where a sealing operation by heating is performed.

Referring to FIGS. 4 to 7, a cryovial sealing apparatus in accordance with a preferred embodiment of the invention is shown. The apparatus is adapted to sealing a cryovial 1. The cryovial 1 is selected from one of a plurality of cryovials having different sizes. First, biological specimens are put into body 11 of the cryovial 1. Next, close an opening of the body 11 by means of a cap 12. Next, put a thermally contractible film 13 on the cryovial 1.

The apparatus comprises the following components as discussed in detailed below. A holder 2 is a cylinder made of a heat-resistant material. The holder 2 comprises a body 21 having a lower extension 211 adapted to secure to a drive unit 3, an upper hole 212 for securing to the body 11 of the cryovial 1 and disposing both the cap 12 and the thermally contractible film 13 externally of the hole 212.

The drive unit 3 is implemented as a motor 31 having an extended rotating shaft 32 secured to the extension 211 such that the holder 2 is capable of turning about its length axis as driven by the motor 31.

A transporting assembly 4 comprises a slide 41, a motor 42, and two supports 43. The slide 41 is operatively connected to the motor 42 and both are mounted on the supports 43. The slide 41 comprises a seat 411 having an elongated upper groove, a sliding block 413 slidably fitted in the groove of the seat 411, a threaded rod 412 having one end threadedly secured to the sliding block 413, and a coupling 414 for interconnecting the other end of the threaded rod 412 and a rotating shaft of the motor 42. As such, the sliding block 413 may slide relative to the seat 411 when the motor 42 activates.

A heating unit 5 is adapted to generate heat and blow hot air toward a periphery of the thermally contractible film 13 on the cryovial 1 so as to quickly contract the thermally contractible film 13 onto the cryovial 1.

A controller 6 is adapted to control operations of the drive unit 3, the transporting assembly 4, and the heating unit 5. Further, parameters including heating time, heating temperatures, and start time and end time of moving the transporting assembly 4 can be set through the controller 6.

A housing 7 is adapted to enclose both the transporting assembly 4 and the heating unit 5 with the controller 6 disposed externally. An exhaust fan 71 is provided on a top of the housing 7 opposite the heating unit 5 for expelling air out of the housing 7.

An operation of sealing the cryovial 1 according to the invention will be described in detailed below. Put biological specimens into the cryovial 1. Close an opening of the cryovial 1 by means of a cap 12. Next, put a thermally contractible film 13 on the cryovial 1. Next, firmly hold the cryovial 1 by means of the holder 2 with a mouth of the cryovial 1 being exposed.

Set parameters including heating time and heating temperature through the controller 6. Next, enable the controller 6 to activate the motor 42 of the transporting assembly 4 to move both the drive unit 3 and the holder 2 relative to the fixed seat 411 from the current position to a heating position.

Then, stop the transporting assembly 4 and activate the motor 31 of the drive unit 3 to turn the holder 2 about a length axis of the cryovial 1. At the same time, the heating unit 5 is enabled by the controller 6 to heat the thermally contractible film 13 for a predetermined period of time equal to the heating time. As a result, the thermally contractible film 13 quickly contracts to sealingly enclose the cryovial 1.

Next, activate the transporting assembly 4 again to move both the drive unit 3 and the holder 2 from the heating position to the original position. This finishes the cryovial sealing operation. It is contemplated by the invention that any possible cracks of a cryovial are sealed. Thus, future permeation of liquid nitrogen through cryovials placed in a liquid nitrogen container during cryopreservation is substantially eliminated.

Figure 8:
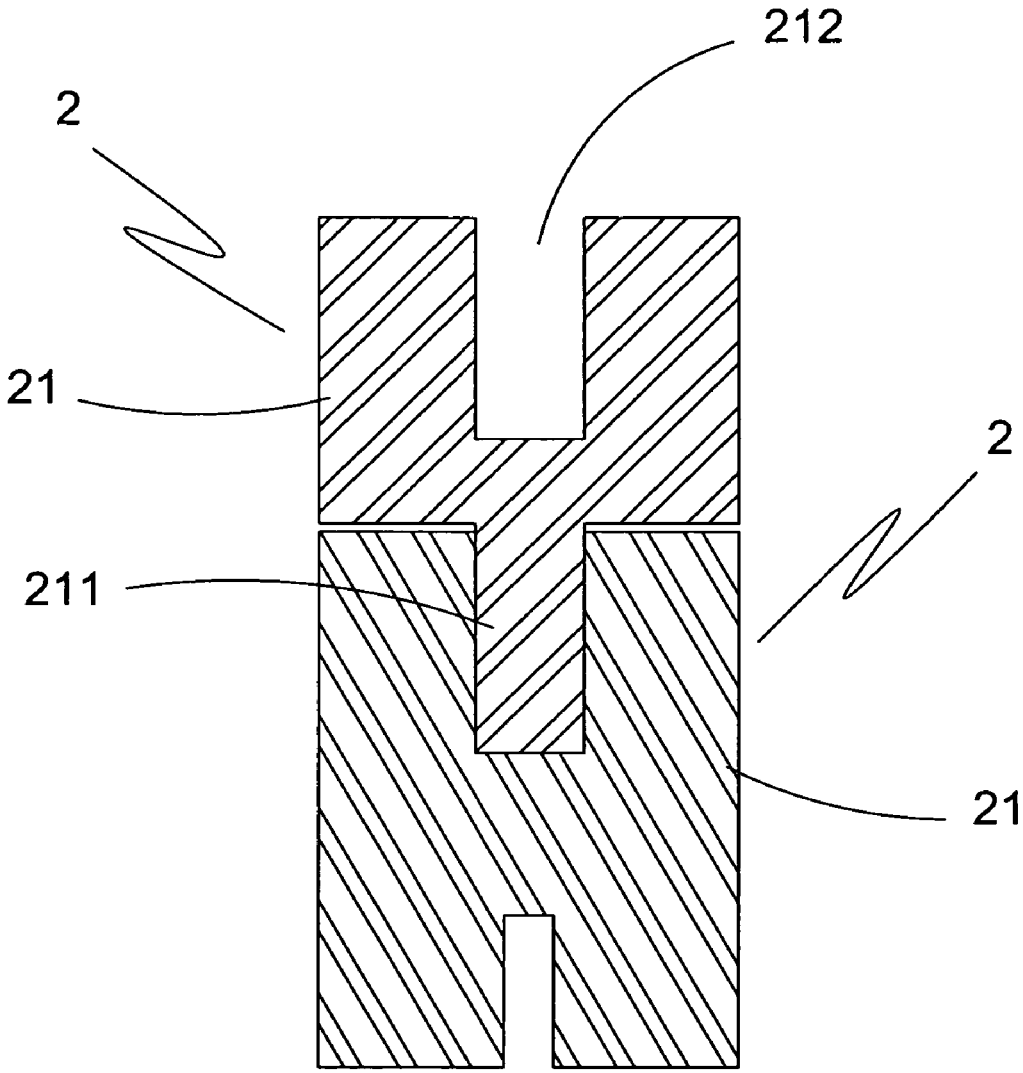
FIG. 8 is a sectional view of the two holders of FIG. 4 being fastened together vertically for increasing elevation of a cryovial of a different length to be secured thereto.

Referring to FIG. 8, two holders 2 are fastened together vertically by tightly inserting the extension 211 of one holder 2 into the hole 212 of the other holder 2. The holders 2 with increased height can increase elevation of a cryovial 1 of a different size (e.g., length) to be secured thereto.

While the invention herein disclosed has been described by means of specific embodiments, numerous modifications and variations could be made thereto by those skilled in the art without departing from the scope and spirit of the invention set forth in the claims.

What is claimed is:

1. An apparatus comprising:

a transporting assembly including a second motor having a rotating shaft, and a slide including a fixed seat having an elongated upper groove, a sliding block slidably fitted in the groove, a threaded rod having one end threadedly secured to the sliding block, and a coupling interconnected the other end of the threaded rod and the rotating shaft of the second motor such that the sliding block is adapted to slide relative to the seat when the second motor activates form an original position to a heating position horizontally;

a holder including a lower extension and an upper hole, wherein a closed cryovial containing biological specimens is secured to the hole and a thermally contractible film is put on the closed cryovial;

a first motor having a rotating shaft secured to the lower extension and the first motor is mounted on the sliding block;

a heating unit for generating heat and blowing hot air;

a housing for enclosing the transporting assembly and the heating unit and including an exhaust fan; and controller means for setting parameters including a heating time and a heating temperature, for activating the second motor to move the first motor and the holder from the original position to the heating position, stopping the second motor and activating the first motor to turn the holder about a longitudinal axis of the cryovial, for activating the heating unit to heat the thermally contractible film to a temperature equal to the heating temperature for a predetermined period of time equal to the heating time for contracting the thermally contractible film onto the cryovial, and for activating the second motor again to move the first motor and the holder from the heating position to the original position with a sealed cryovial.

* * * * *